US007187353B2

(12) United States Patent
Credelle et al.

(10) Patent No.: US 7,187,353 B2
(45) Date of Patent: Mar. 6, 2007

(54) DOT INVERSION ON NOVEL DISPLAY PANEL LAYOUTS WITH EXTRA DRIVERS

(75) Inventors: Thomas Lloyd Credelle, Morgan Hill, CA (US); Matthew Osborne Schlegel, Palo Alto, CA (US)

(73) Assignee: Clairvoyante, Inc, Sebastopol, CA (US)

( * ) Notice: Subject to any disclaimer, the term of this patent is extended or adjusted under 35 U.S.C. 154(b) by 377 days.

(21) Appl. No.: 10/456,806

(22) Filed: Jun. 6, 2003

(65) Prior Publication Data

US 2004/0246279 A1 Dec. 9, 2004

(51) Int. Cl.
*G09G 3/36* (2006.01)

(52) U.S. Cl. ..... 345/88

(58) Field of Classification Search ..... 345/88, 345/597, 589, 591
See application file for complete search history.

(56) References Cited

U.S. PATENT DOCUMENTS

| | | | | |
|---|---|---|---|---|
| 3,971,065 | A | 7/1976 | Bayer | |
| 4,353,062 | A | 10/1982 | Lorteije et al. | |
| 4,642,619 | A | 2/1987 | Togashi | |
| 4,651,148 | A | 3/1987 | Takeda et al. | |
| 4,773,737 | A | 9/1988 | Yokono et al. | |
| 4,781,438 | A * | 11/1988 | Noguchi | 349/54 |
| 4,800,375 | A | 1/1989 | Silverstein et al. | |
| 4,853,592 | A | 8/1989 | Strathman | |
| 4,874,986 | A | 10/1989 | Menn et al. | |
| 4,886,343 | A | 12/1989 | Johnson | |
| 4,908,609 | A | 3/1990 | Stroomer | |
| 4,920,409 | A | 4/1990 | Yamagishi | |
| 4,965,565 | A * | 10/1990 | Noguchi | 345/93 |
| 5,052,785 | A | 10/1991 | Takimoto et al. | |
| 5,097,297 | A | 3/1992 | Nakazawa | |
| 5,113,274 | A * | 5/1992 | Takahashi et al. | 349/109 |
| 5,144,288 | A | 9/1992 | Hamada et al. | |
| 5,184,114 | A | 2/1993 | Brown | |
| 5,191,451 | A | 3/1993 | Katayama et al. | |
| 5,311,205 | A | 5/1994 | Hamada et al. | |
| 5,311,337 | A | 5/1994 | McCartney, Jr. | |
| 5,315,418 | A | 5/1994 | Sprague et al. | |
| 5,334,996 | A | 8/1994 | Tanigaki et al. | |

(Continued)

FOREIGN PATENT DOCUMENTS

DE 299 09 537 U1 10/1999

(Continued)

OTHER PUBLICATIONS

Brown Elliott, C., "Color Subpixel Rendering Projectors and Flat Panel Displays," SMPTE, Feb. 27-Mar. 1, 2003, Seattle, WA pp. 1-4.

(Continued)

*Primary Examiner*—Sumati Lefkowitz
*Assistant Examiner*—Rodney Amadiz

(57) ABSTRACT

Dot inversion schemes are disclosed on novel display panel layouts with extra drivers. A display panel comprises substantially a set of a subpixel repeating group comprising a pattern of six columns and two rows:

| | | | | | |
|---|---|---|---|---|---|
| R | R | G | B | B | G |
| B | B | G | R | R | G |

wherein at least one set of adjacent column subpixels share image data from a single driver upon the display panel.

19 Claims, 8 Drawing Sheets

U.S. PATENT DOCUMENTS 5,341,153 A 8/1994 Benzschawel et al.
5,398,066 A 3/1995 Martinez-Uriegas et al.
5,436,747 A 7/1995 Suzuki
5,457,552 A * 10/1995 Ogurtsov et al. ..... 349/54
5,459,595 A 10/1995 Ishiguro
5,461,503 A 10/1995 Deffontaines et al.
5,485,293 A 1/1996 Robinder
5,535,028 A 7/1996 Bae et al.
5,563,621 A 10/1996 Silsby
5,579,027 A 11/1996 Sakurai et al.
5,646,702 A 7/1997 Akinwande et al.
5,648,793 A 7/1997 Chen
5,715,025 A * 2/1998 Ogurtsov et al. ..... 349/41
5,739,802 A 4/1998 Mosier
5,754,163 A 5/1998 Kwon
5,754,226 A 5/1998 Yamada et al.
5,767,829 A 6/1998 Verhulst
5,808,594 A 9/1998 Tsubyama et al.
5,818,405 A 10/1998 Eglit et al.
5,899,550 A 5/1999 Masaki
5,949,396 A 9/1999 Lee
5,971,546 A 10/1999 Park
6,005,692 A 12/1999 Stahl
6,008,868 A 12/1999 Silverbrook
6,037,719 A 3/2000 Yap et al.
6,064,363 A 5/2000 Kwon
6,069,670 A 5/2000 Borer
6,088,050 A 7/2000 Ng
6,097,367 A 8/2000 Kuriwaki et al.
6,108,122 A 8/2000 Ulrich et al.
6,144,352 A 11/2000 Matsuda et al.
6,147,664 A 11/2000 Hansen
6,151,001 A 11/2000 Anderson et al.
6,160,535 A 12/2000 Park
6,188,385 B1 2/2001 Hill et al.
6,219,025 B1 4/2001 Hill et al.
6,225,967 B1 5/2001 Hebiguchi
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,278,434 B1 8/2001 Hill et al.
6,326,981 B1 12/2001 Mori et al.
6,327,008 B1 12/2001 Fujiyoshi
6,332,030 B1 12/2001 Manjunath et al.
6,342,876 B1 1/2002 Kim
6,348,929 B1 2/2002 Acharya et al.
6,377,262 B1 4/2002 Hitchcock et al.
6,388,644 B1 5/2002 De Zwart et al.
6,392,717 B1 5/2002 Kunzman
6,393,145 B2 5/2002 Betrisey et al.
6,396,505 B1 5/2002 Lui et al.
6,417,868 B1 * 7/2002 Bock et al. ..... 345/698
6,469,766 B2 10/2002 Waterman et al.
6,545,653 B1 4/2003 Takahara et al.
6,552,706 B1 * 4/2003 Ikeda et al. ..... 345/96
6,570,584 B1 5/2003 Cok et al.
6,590,555 B2 7/2003 Su et al.
6,624,828 B1 9/2003 Dresevic et al.
6,661,429 B1 12/2003 Phan
6,674,436 B1 1/2004 Dresevic et al.
6,680,761 B1 1/2004 Greene et al.
6,714,206 B1 3/2004 Martin et al.
6,714,212 B1 3/2004 Tsuboyama et al.
6,714,243 B1 3/2004 Mathur et al.
6,738,204 B1 5/2004 Chuang et al.
6,750,875 B1 6/2004 Keely, Jr. et al.
6,771,028 B1 8/2004 Winters
6,804,407 B2 10/2004 Weldy
6,833,890 B2 12/2004 Hong et al.
6,836,300 B2 12/2004 Choo et al.
6,850,294 B2 2/2005 Roh et al.
6,850,305 B2 * 2/2001 Hsieh et al. ..... 349/144
6,867,549 B2 3/2005 Cok et al.
6,885,380 B1 4/2005 Primerano et al.
6,888,604 B2 5/2005 Rho et al.
6,897,876 B2 5/2005 Murdoch et al.
6,903,378 B2 6/2005 Cok
2001/0015716 A1 8/2001 Kim
2001/0017607 A1 * 8/2001 Kwon et al. ..... 345/87
2002/0093476 A1 7/2002 Hill et al.
2002/0158997 A1 10/2002 Fukami et al.
2003/0006978 A1 1/2003 Fujiyoshi
2003/0011603 A1 1/2003 Koyama et al.
2003/0071943 A1 4/2003 Choo et al.
2003/0077000 A1 4/2003 Blinn et al.
2003/0146893 A1 8/2003 Sawabe
2003/0218618 A1 11/2003 Phan
2004/0008208 A1 1/2004 Dresevic et al.
2004/0021804 A1 2/2004 Hong et al.
2004/0061710 A1 4/2004 Messing et al.
2004/0094766 A1 5/2004 Lee et al.
2004/0095521 A1 5/2004 Song et al.
2004/0114046 A1 6/2004 Lee et al.
2004/0150651 A1 8/2004 Phan
2004/0155895 A1 8/2004 Lai
2004/0169807 A1 9/2004 Rho et al.
2004/0174389 A1 9/2004 Ben-David et al.
2004/0179160 A1 9/2004 Rhee et al.
2004/0189662 A1 9/2004 Frisken et al.
2004/0189664 A1 9/2004 Frisken et al.
2004/0213449 A1 10/2004 Safee-Rad et al.
2004/0223005 A1 11/2004 Lee
2004/0239813 A1 12/2004 Klompenhouwer
2004/0239837 A1 12/2004 Hong et al.
2004/0246213 A1 12/2004 Credelle et al.
2004/0246278 A1 12/2004 Elliott
2004/0246280 A1 12/2004 Credelle et al.
2004/0246381 A1 12/2004 Credelle
2004/0246404 A1 12/2004 Elliott et al.
2004/0247070 A1 12/2004 Ali et al.
2005/0007539 A1 1/2005 Taguchi et al.
2005/0024380 A1 2/2005 Lin et al.
2005/0040760 A1 2/2005 Taguchi et al.
2005/0068477 A1 3/2005 Shin et al.
2005/0083356 A1 4/2005 Roh et al.
2005/0140634 A1 6/2005 Takatori
2005/0151752 A1 7/2005 Phan
2005/0162600 A1 7/2005 Rho et al.
2005/0219274 A1 10/2005 Yang et al.

FOREIGN PATENT DOCUMENTS

DE 199 23 527 11/2000
DE 201 09 354 U1 9/2001
EP 0 322 106 A2 6/1989
EP 1 381 020 A2 1/2004
JP 60-107022 6/1985
JP 03-78390 4/1991
JP 06-102503 4/1994
JP 08-202317 8/1996
JP 11-282008 10/1999
JP 2004-004822 1/2004
WO WO 2004/021323 A2 3/2004
WO WO 2004/027503 A1 4/2004
WO WO 2004/086128 A1 10/2004
WO WO 2005/050296 A1 6/2005

OTHER PUBLICATIONS

Brown Elliott, C, "Co-Optimization of Color AMLCD Subpixel Architecture and Rendering Algorithms," SID 2002 Proceedings Paper, May 30, 2002 pp. 172-175.

Brown Elliott, C, "Development of the PenTile Matrix™ Color AMLCD Subpixel Architecture and Rendering Algorithms", SID 2003, Journal Article.
Brown Elliott, C, "New Pixel Layout for PenTile Matrix™ Architecture". IDMC 2002, pp. 115-117.
Brown Elliott, C, "Pentile Matirx™ Displays and Drivers" ADEAC Proceedings Paper, Portland OR., Oct. 2005.
Brown Elliott, C, "Development of the PenTile Matrix™ Color AMLCD Subpixel Architecture and Rendering Algorithms", SID 2003, Journal Article.
Brown Elliott, C, "Reducing Pixel Count Without Reducing Image Quality", Information Display Dec. 1999, vol. 1, pp. 22-25.
Credelle, Thomas, "P-00: MTF of High-Resolution PenTile Matrix Displays", Eurodisplay 02 Digest, 2002 pp. 1-4.
Daly, Scott, "Analysis of Subtriad Addressing Algorithms by Visual System Models",SID Symp. Digest, Jun. 2001 pp. 1200-1203.
Klompenhouwer, Michial, Subpixel Image Scaling for Color Matrix Displays, SID Symp. Digest, May 2002, pp. 176-179.
Krantz, John et al., Color Matrix Display Image Quality: The Effects of Luminance . . . SID 90 Digest, pp. 29-32.
Lee, Baek-woon et al., 40.5L: Late-News Paper: TFT-LCD with RGBW Color system, SID 03 Digest, 2003, pp. 1212-1215.
Messing, Dean et al., Improved Display Resolution of Subsampled Colour Images Using Subpixel Addressing, IEEE ICIP 2002, vol. 1, pp. 625-628.
Messing, Dean et al., Subpixel Rendering on Non-Striped Colour Matrix Displays, 2003 International Conf on Image Processing, Sep. 2003, Barcelona, Spain, 4 pages.
Okumura et al., "A New Flicker-Reduction Drive Method for High Resolution LCTVs", SID Digest,pp. 551-554, 2001.
Non-Final Office Action, dated Oct. 26, 2005 in U.S. Appl. No. 10/455,925 (8 pages).
Non-Final Office Action, dated Oct. 19, 2004 in U.S. Appl. No. 10/455,931 (4 pages).
Response to Non-Final Office Action, dated Jan. 18, 2005 in U.S. Appl. No. 10/455,931 (6 pages).
Final Office Action, dated Jul. 12, 2005 in U.S. Appl. No. 10/455,931 (4 pages).
Response to Final Office Action, dated Jan. 12, 2006 in U.S. Appl. No. 10/455,931 (10 pages).
Non-Final Office Action, dated Jan. 23, 2006 in U.S. Appl. No. 10/455,927 (4 pages).
Non-Final Office Action, dated Sep. 2, 2004 in U.S. Appl. No. 10/456,838 (6 pages).
Response to Non-Final Office Action, dated Jan. 28, 2005 in U.S. Appl. No. 10/456,838 (8 pages).
Final Office Action, dated Jun. 9, 2005 in U.S. Appl. No. 10/456,838 (6 pages).
Response to Final Office Action, dated Dec. 5, 2005 in U.S. Appl. No. 10/456,838 (10 pages).
Non-Final Office Action, dated Jul. 26, 2004 in U.S. Appl. No. 10/456,794 (3 pages).
Response to Non-Final Office Action, dated Nov. 8, 2004 in U.S. Appl. No. 10/456,794 (6 pages).
Non-Final Office Action, dated May 4, 2005 in U.S. Appl. No. 10/456,794 (6 pages).
Response to Non-Final Office Action, dated Nov. 3, 2005 in U.S. Appl. No. 10/456,794 (7 pages).

* cited by examiner

DOT INVERSION ON NOVEL DISPLAY PANEL LAYOUTS WITH EXTRA DRIVERS

RELATED APPLICATIONS

The present application is related to commonly owned (and filed on even date) United States patent applications: (1) United States patent Publication No. 2004/0246213 ("the '213 application") [U.S. patent application Ser. No. 10/455,925] entitled "DISPLAY PANEL HAVING CROSSOVER CONNECTIONS EFFECTING DOT INVERSION"; (2) United States Patent Publication No. 2004/0246381 ("the '381 application") [U.S. patent application Ser. No. 10/455,931] entitled "SYSTEM AND METHOD OF PERFORMING DOT INVERSION WITH STANDARD DRIVERS AND BACKPLANE ON NOVEL DISPLAY PANEL LAYOUTS"; (3) United States Patent Publication No. 2004/0246278 ("the '278 application") [U.S. patent application Ser. No. 10/455,927] entitled "SYSTEM AND METHOD FOR COMPENSATING FOR VISUAL EFFECTS UPON PANELS HAVING FIXED PATTERN NOISE WITH REDUCED QUANTIZATION ERROR"; (4) United States Patent Publication No. 2004/0246404 ("the '404 application") [U.S. patent application Ser. No. 10/456,838] entitled "LIQUID CRYSTAL DISPLAY BACKPLANE LAYOUTS AND ADDRESSING FOR NON-STANDARD SUBPIXEL ARRANGEMENTS"; and (5) United States Patent Publication No. 2004/0246280 ("the '280 application") [U.S. patent application Ser. No. 10/456,839] entitled "IMAGE DEGRADATION CORRECTION IN NOVEL LIQUID CRYSTAL DISPLAYS," which are hereby incorporated herein by reference.

In commonly owned United States patent applications: (1) United States Patent Publication No. 2002/0015110 ("the '110 application") [U.S. patent application Ser. No. 09/916,232] entitled "ARRANGEMENT OF COLOR PIXELS FOR FULL COLOR IMAGING DEVICES WITH SIMPLIFIED ADDRESSING," filed Jul. 25, 2001; (2) United States Patent Publication No. 2003/0128225 ("the '225 application") [U.S. patent application Ser. No. 10/278,353] entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") [U.S. patent application Ser. No. 10/278,352] entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") [U.S. patent application Ser. No. 10/243,094] entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") [U.S. patent application Ser. No. 10/278,328] entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") [U.S. patent application Ser. No. 10/278,393] entitled "COLOR DISPLAY HAVING HORIZONTAL SUB-PIXEL ARRANGEMENTS AND LAYOUTS," filed Oct. 22, 2002; (7) United States Patent Publication No. 2004/0080479 ("the '479 application") [U.S. patent application Ser. No. 10/347,001] entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, novel sub-pixel arrangements are therein disclosed for improving the cost/performance curves for image display devices and herein incorporated by reference.

These improvements are particularly pronounced when coupled with sub-pixel rendering (SPR) systems and methods further disclosed in those applications and in commonly owned United States patent applications: (1) United States Patent Publication No. 2003/0034992 ("the '992 application") [U.S. patent application Ser. No. 10/051,612] entitled "CONVERSION OF A SUB-PIXEL FORMAT DATA TO ANOTHER SUB-PIXEL DATA FORMAT," filed Jan. 16, 2002; (2) United States Patent Publication No. 2003/0103058 ("the '058 application") [U.S. patent application Ser. No. 10/150,355] entitled "METHODS AND SYSTEMS FOR SUB-PIXEL RENDERING WITH GAMMA ADJUSTMENT," filed May 17, 2002; (3) United States Patent Publication No. 2003/0085906 ("the '906 application") [U.S. patent application Ser. No. 10/215,843] entitled "METHODS AND SYSTEMS FOR SUB-PIXEL RENDERING WITH ADAPTIVE FILTERING," filed Aug. 8, 2002; (4) United States Patent Publication No. 2004/0196302 ("the '302 application") [U.S. patent application Ser. No. 10/379,767] entitled "SYSTEMS AND METHODS FOR TEMPORAL SUB-PIXEL RENDERING OF IMAGE DATA" filed Mar. 4, 2003; (5) United States Patent Publication No. 2004/0174380 ("the '380 application") [U.S. patent application Ser. No. 10/379,765] entitled "SYSTEMS AND METHODS FOR MOTION ADAPTIVE FILTERING," filed Mar. 4, 2003; (6) U.S. Pat. No. 6,917,368 ("the '368 patent") [U.S. patent application Ser. No. 10/379,766] entitled "SUB-PIXEL RENDERING SYSTEM AND METHOD FOR IMPROVED DISPLAY VIEWING ANGLES" filed Mar. 4, 2003; (7) United States Patent Publication No. 2004/0196297 ("the '297 application") [U.S. patent application Ser. No. 10/409,413] entitled "IMAGE DATA SET WITH EMBEDDED PRE-SUB-PIXEL RENDERED IMAGE" filed Apr. 7, 2003, which are hereby incorporated herein by reference.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Figure 1A:
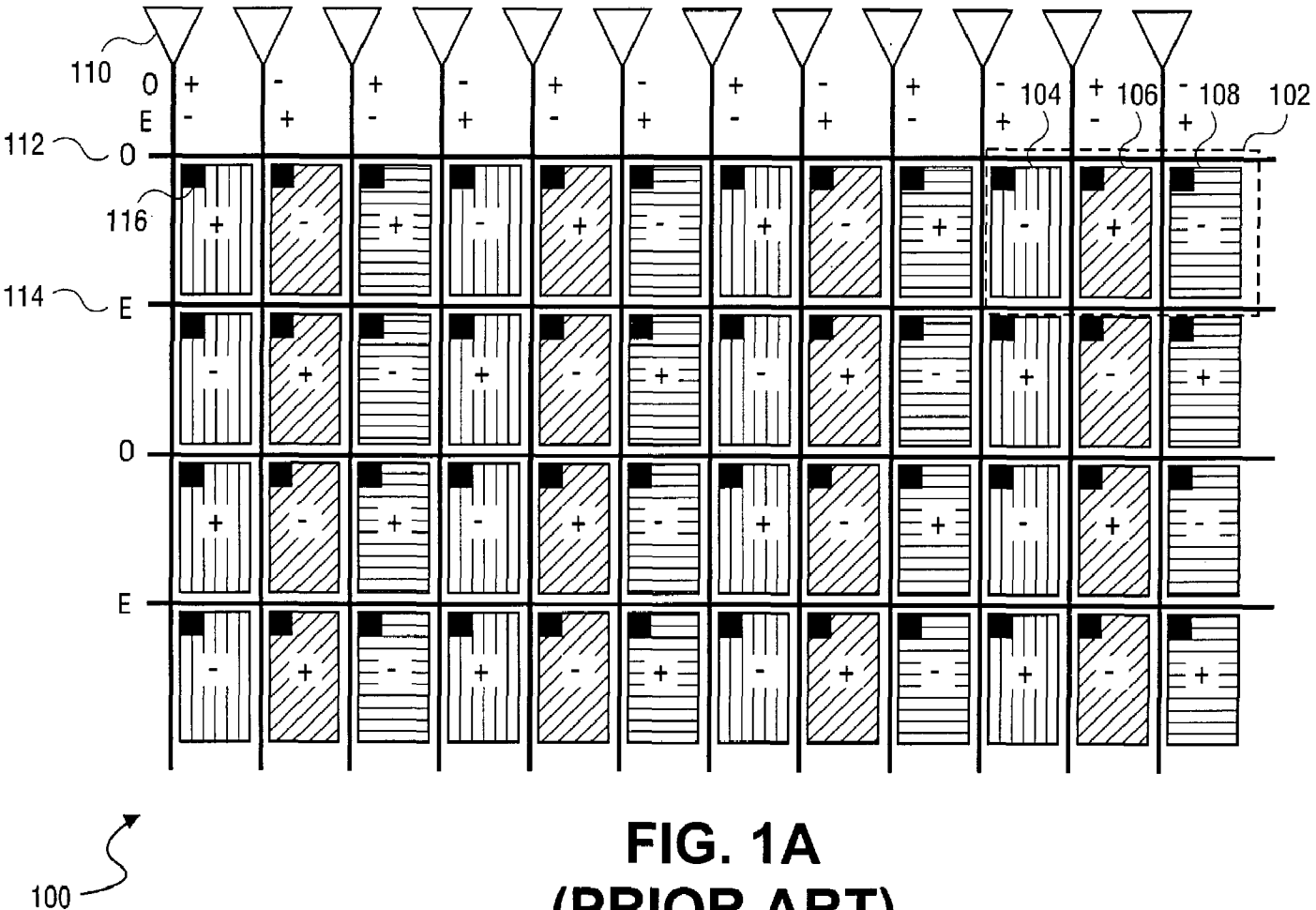
FIG. 1A (PRIOR ART)
FIG. 1A depicts a typical RGB striped panel display having a standard 1×1 dot inversion scheme.

FIG. 1A shows a conventional RGB stripe structure on panel 100 for an Active Matrix Liquid Crystal Display (AMLCD) having thin film transistors (TFTs) 116 to activate individual colored subpixels—red 104, green 106 and blue 108 subpixels respectively. As may be seen, a red, a green and a blue subpixel form a repeating group of subpixels 102 that comprise the panel.

As also shown, each subpixel is connected to a column line (each driven by a column driver 110) and a row line (e.g. 112 and 114). In the field of AMLCD panels, it is known to drive the panel with a dot inversion scheme to reduce crosstalk and flicker. FIG. 1A depicts one particular dot inversion scheme—i.e. 1×1 dot inversion—that is indicated by a "+" and a "−" polarity given in the center of each subpixel. Each row line is typically connected to a gate (not shown in FIG. 1A) of TFT 116. Image data—delivered via the column lines—are typically connected to the source of each TFT. Image data is written to the panel a row at a time and is given a polarity bias scheme as indicated herein as either ODD ("O") or EVEN ("E") schemes. As shown, row 112 is being written with ODD polarity scheme at a given time while row 114 is being written with EVEN polarity scheme at a next time. The polarities alternate ODD and EVEN schemes a row at a time in this 1×1 dot inversion scheme.

Figure 1B:
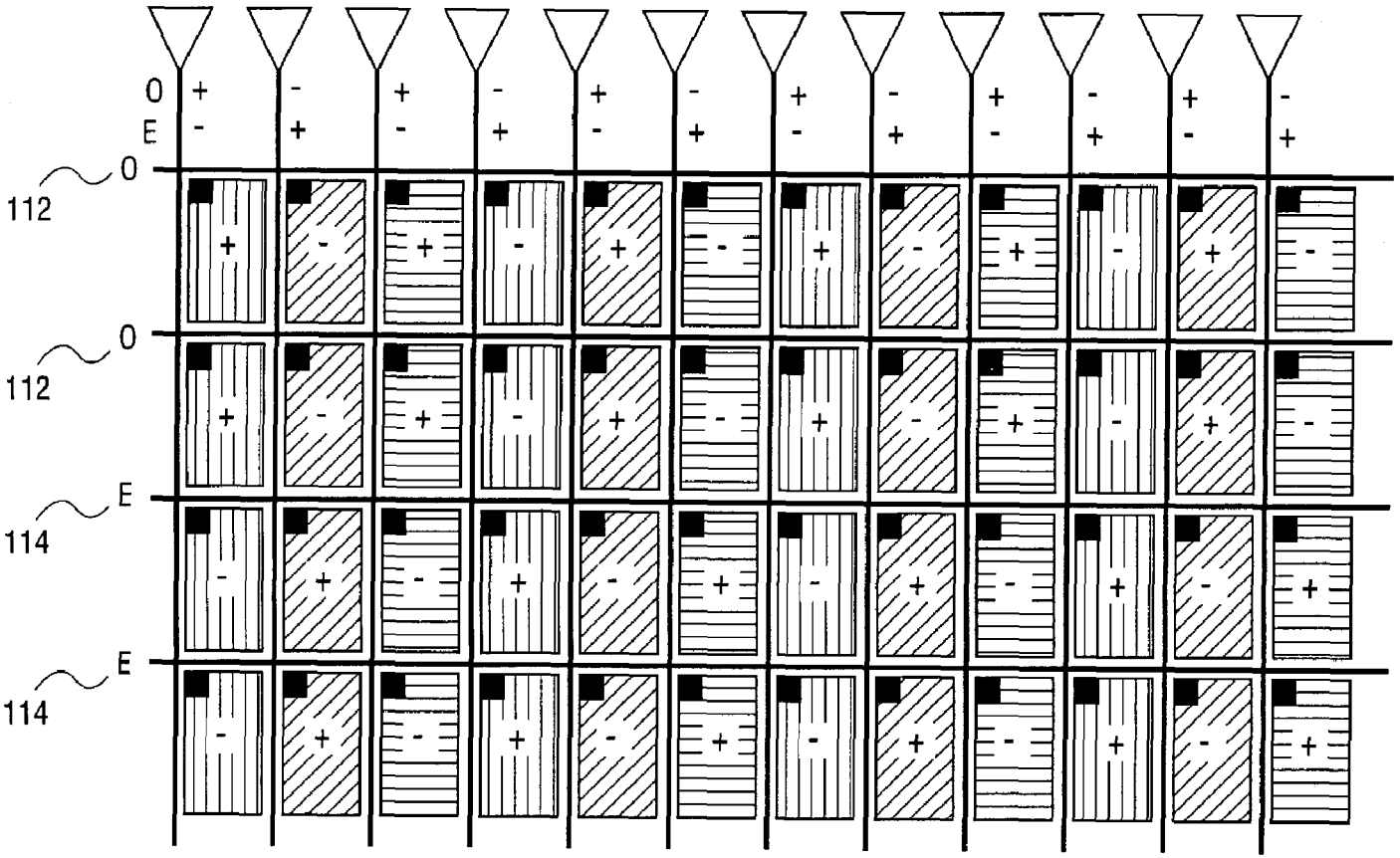
FIG. 1B (PRIOR ART)
FIG. 1B depicts a typical RGB striped panel display having a standard 1×2 dot inversion scheme.

FIG. 1B depicts another conventional RGB stripe panel having another dot inversion scheme—i.e. 1×2 dot inversion. Here, the polarity scheme changes over the course of two rows—as opposed to every row, as in 1×1 dot inversion. In both dot inversion schemes, a few observations are noted: (1) in 1×1 dot inversion, every two physically adjacent subpixels (in both the horizontal and vertical direction) are of different polarity; (2) in 1×2 dot inversion, every two physically adjacent subpixels in the horizontal direction are of different polarity; (3) across any given row, each successive colored subpixel has an opposite polarity to its neighbor. Thus, for example, two successive red subpixels along a row will be either (+,−) or (−,+). Of course, in 1×1 dot inversion, two successive red subpixels along a column with have opposite polarity; whereas in 1×2 dot inversion, each group of two successive red subpixels will have opposite polarity. This changing of polarity decreases noticeable visual effects that occur with particular images rendered upon and AMLCD panel.

Figure 2:
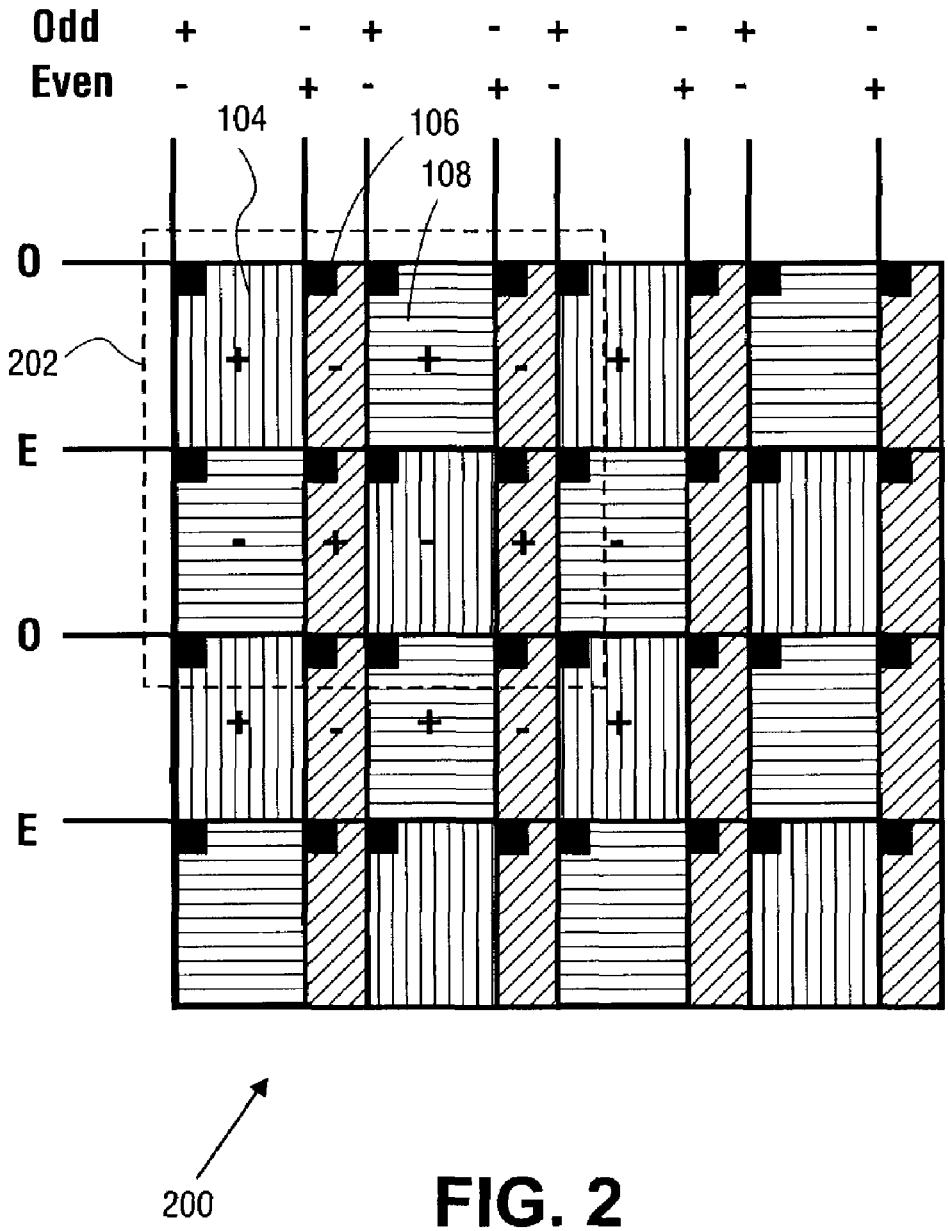
FIG. 2 depicts a novel panel display comprising a sub-pixel repeat grouping that is of even modulo.

FIG. 2 shows a panel comprising a repeat subpixel grouping 202, as further described in the '225 application. As may be seen, repeat subpixel grouping 202 is an eight subpixel repeat group, comprising a checkerboard of red and blue subpixels with two columns of reduced-area green subpixels in between. If the standard 1×1 dot inversion scheme is applied to a panel comprising such a repeat grouping (as shown in FIG. 2), then it becomes apparent that the property described above for RGB striped panels (namely, that successive colored pixels in a row and/or column have different polarities) is now violated. This condition may cause a number of visual defects noticed on the panel—particularly when certain image patterns are displayed. This observation also occurs with other novel subpixel repeat grouping—for example, the subpixel repeat grouping in FIG. 1 of the '179 application—and other repeat groupings that are not an odd number of repeating subpixels across a row. Thus, as the traditional RGB striped panels have three such repeating subpixels in its repeat group (namely, R, G and B), these traditional panels do not necessarily violate the above noted conditions. However, the repeat grouping of FIG. 2 in the present application has four (i.e. an even number) of subpixels in its repeat group across a row (e.g. R, G, B, and G). It will be appreciated that the embodiments described herein are equally applicable to all such even modulus repeat groupings.

Figure 3:
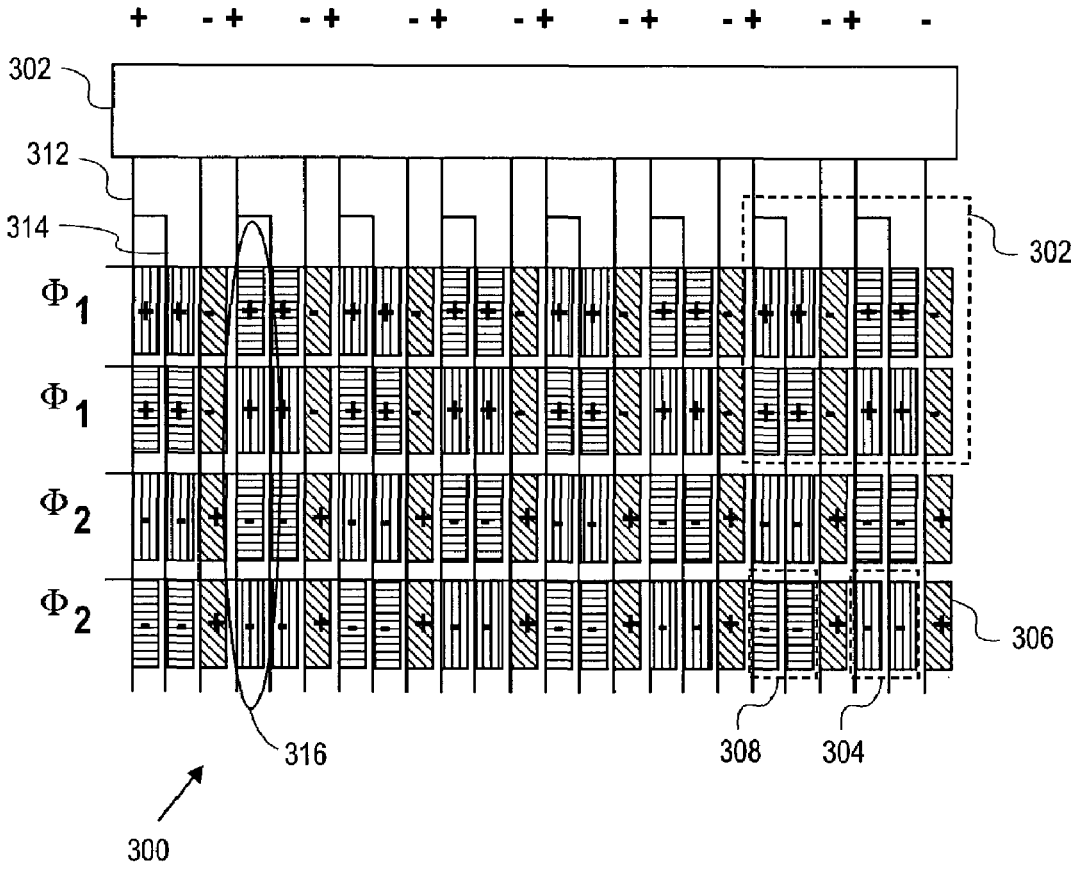
FIG. 3 shows one embodiment of a display panel having a novel subpixel repeating group structure of six subpixels along a row by two columns having a set of regularly occurring interconnects to enable sharing of image data for at least two columns.

FIG. 3 is a panel having a novel subpixel repeating group that is a variation of the subpixel repeating group found in FIG. 2. The repeating group 302 is comprised of double red subpixels 304 and double blue subpixels 308 (where each such red and blue subpixel could be sized, for one embodiment, approximately the same size as a standard RGB striped subpixel), and a reduced green subpixel 306 (which also could be sized, for one embodiment, approximately the same size as regular RGB striped subpixel). Each double red and double blue subpixels would ostensibly act as one larger red or blue subpixel, respectively (such as shown in FIG. 2)—thus, one embodiment would have interconnects 314 coming from red and blue column lines 312 so that the image data would be shared by the double red and blue subpixels. One possible advantage of using regularly sized RGB striped subpixels as one embodiment is that existing TFT backplanes may be employed—thereby reducing some manufacture re-design costs. Another possible advantage is that—with the interconnects—a reduced number of drivers is needed to drive the entire panel.

FIG. 3 also shows one possible dot inversion scheme (e.g. 1×2) implemented on the panel by driver chip 302. As discussed above, the fact that same colored subpixels across a row have the same polarity may induce undesirable visual effects. Additionally, the fact that adjacent columns (as depicted in oval 316) have the same polarities may also create undesirable visual effects.

Figure 4:
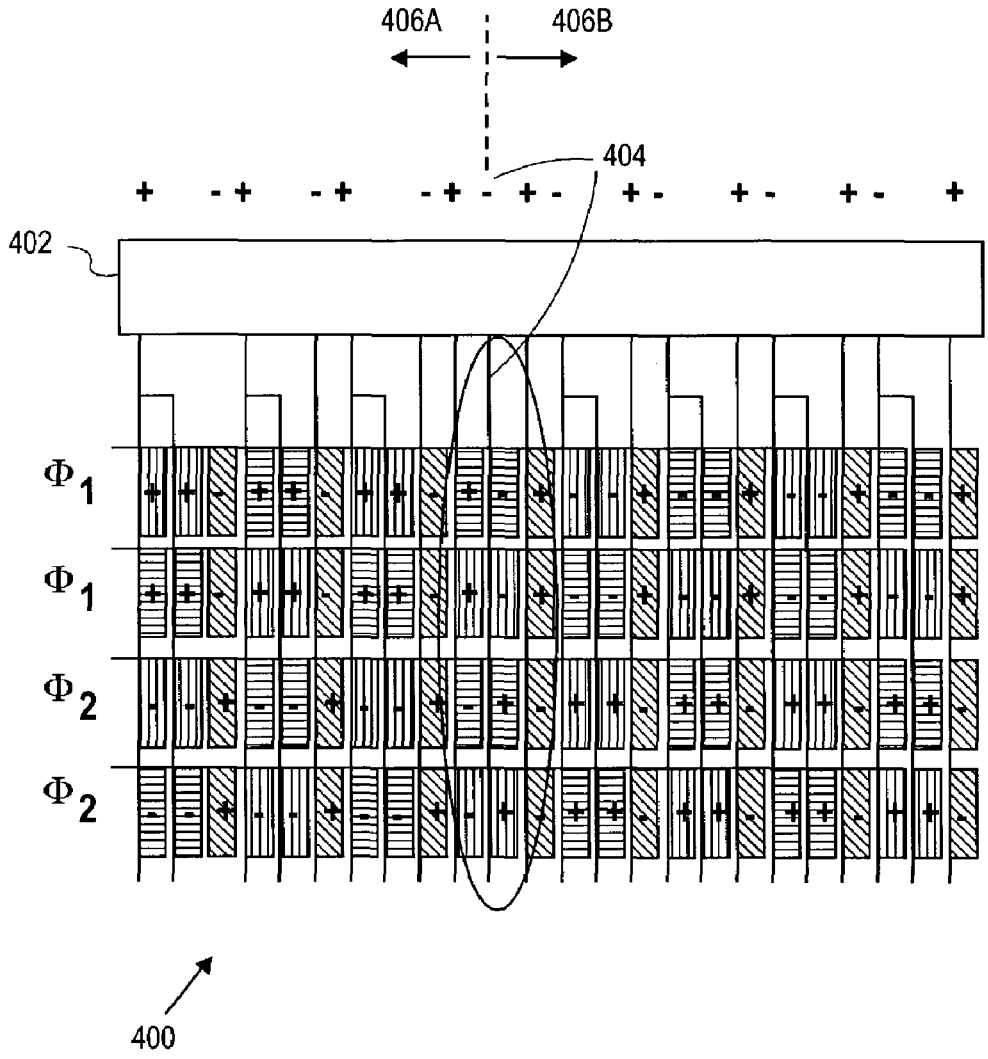
FIG. 4 shows the display panel of FIG. 3 wherein at least one regularly occurring interconnect is missing to effect different regions of polarity for same colored subpixels.

FIG. 4 shows one possible embodiment of a system that can remove or abate the visual defects above. In this case, an extra driver 404 (which could be assigned from some of the column drivers saved by virtue of use of interconnects) is assigned to one of the double red and blue subpixel columns. By occasionally assigning an extra driver to such a column across the panel, it can be seen that the same colored subpixels on either side of the extra driver (e.g. 406*a* and 406*b*) switch polarity—which will have the tendency to abate the visual effects induced as described above. How often to assign such drivers across a given panel design can be determined heuristically or empirically—clearly, there should be enough extra drivers to abate the visual effect; but any more than that may not be needed. It will be appreciated that although a 1×2 dot inversion scheme is shown, other inversion schemes will also benefit from the techniques described herein.

Figure 5:
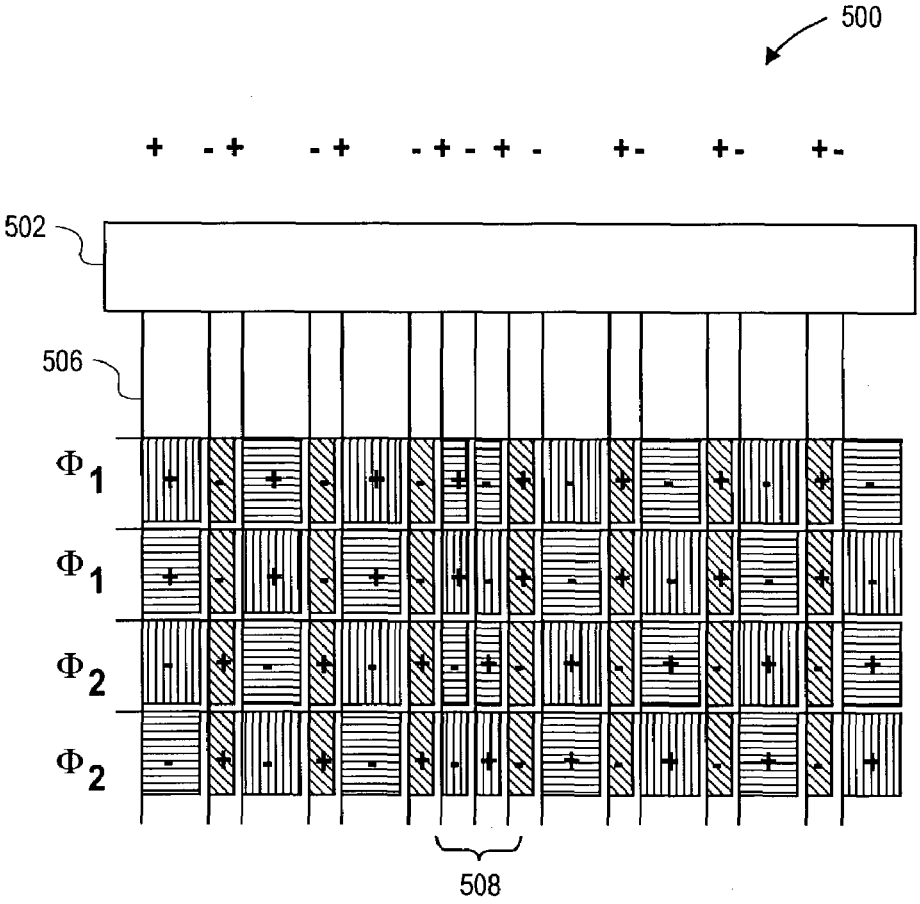
FIG. 5 shows another embodiment of a display panel having a subpixel repeating group structure of two column of larger subpixels and two columns of smaller subpixels wherein at least one such column of larger subpixels is split to effect different regions of polarity for same colored subpixels.

FIG. 5 is yet another embodiment of a panel 500 having a novel subpixel repeating group. Panel 500 comprises substantially the same repeat grouping shown in FIG. 2—but, occasionally, one of the red and blue subpixel columns is split (as shown in 508) and an extra driver from the driver chip 502 is assigned to the split column. The effect of this split column is similar to the effect as produced in FIG. 4 above. An advantage of this embodiment is that the capacitance due to the column line that serves as the load to the driver is substantially reduced, thereby reducing the power required to drive the column. With the combined use of full size and smaller sized subpixels though, there might be an unintended consequence of off-axis viewing angle differences. Such viewing angle differences might be compensated for, as described in several co-pending applications that are incorporated above and in the following paragraphs.

Figure 7A:
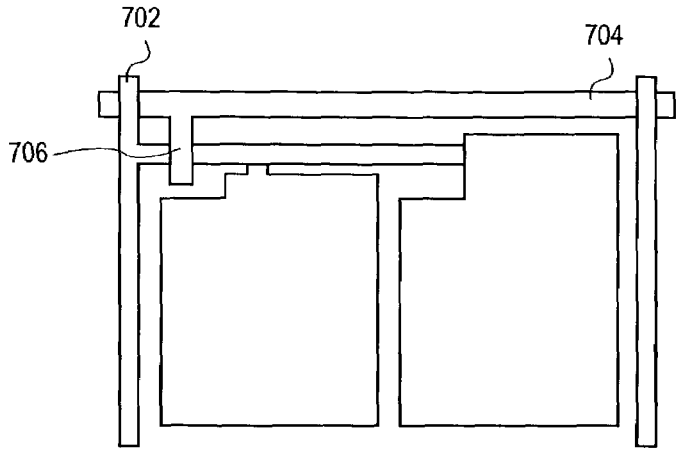
FIGS. 7A, 7B, and 7C show embodiments of illumnating areas for a display panel with thin-film transistors (TFTs).
Figure 7B:
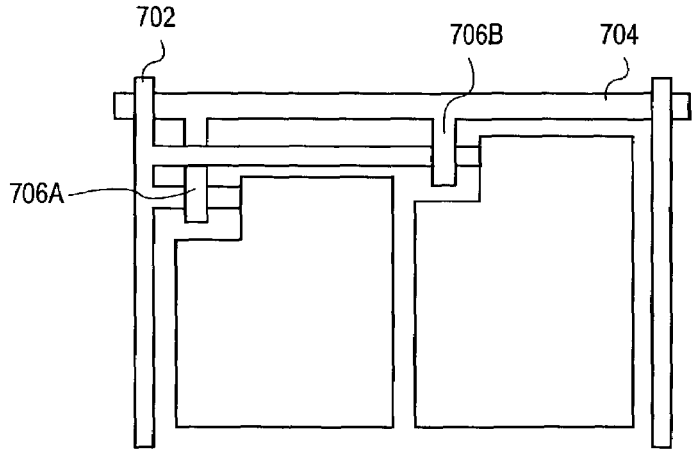
Figure 7C:
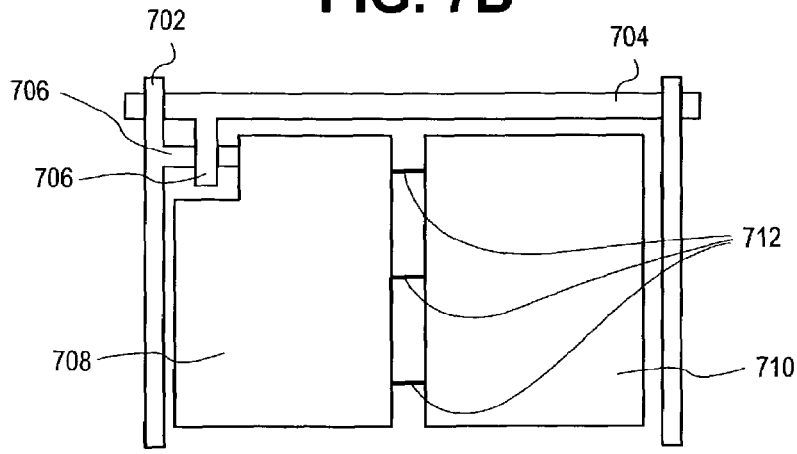

Another embodiment that may address viewing angles is a technique whereby the viewing angle characteristics of the larger pixel are designed to match those of the smaller pixel. In FIGS. 7A, 7B and 7C, this is accomplished by creating one large pixel, comprised of two small illuminating areas, each of which has the same viewing angle characteristics of the small size pixel. In FIG. 7A, each illuminating area is driven by TFT 706. TFT 706 is connected to the column line 702 and the gate line 704. In the embodiment described in FIG. 7B, the output of TFT 706A drives a first illuminating area, and TFT 706B drives a second illuminating area. In FIG. 7C, the electrode 708 is connected directly to the electrode 710 via a plurality of interconnects 712 in one or more locations. This embodiment allows greater aperture ratio.

The embodiment of FIGS. 7A, 7B, and 7C are shown for a standard TFT layout. It should appreciated that the electrode patterns for some viewing angle technologies—such as In Plane Switching—are different. These concepts will still apply to all viewing angle technologies.

Figure 6:
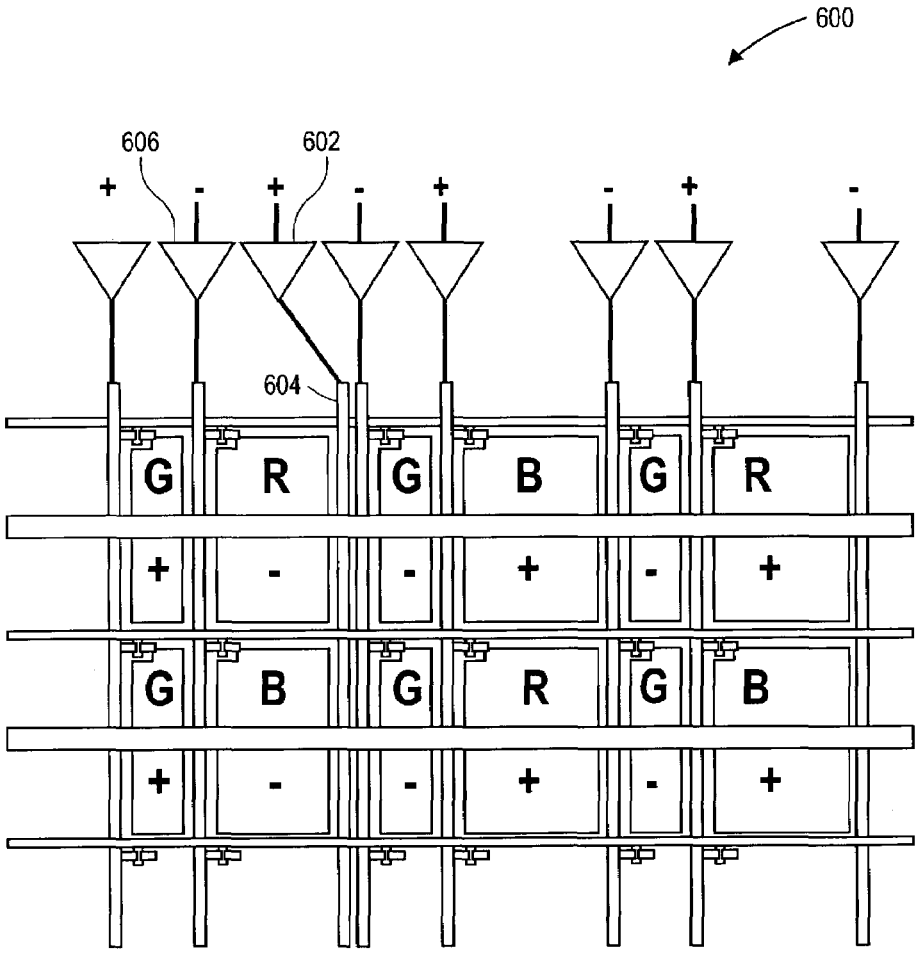
FIG. 6 shows another embodiment of a display panel having a subpixel repeating group structure of even modulo wherein an extra driver is employed with a column line running down the panel to shield against undesirable visual effects from occurring on the panel.

Yet another embodiment using additional drivers is depicted in FIG. 6. Panel 600 could be comprising the subpixel repeating group as shown in FIG. 2—or any other suitable even-modulo grouping. It is appreciated that this technique could be applied with or without double or split subpixels. Extra driver 602 is connected to a column line 602—which could be a "dummy" line—i.e. not connected to any TFT or the like. As column line 602 is being driven with opposite polarity as adjacent column line 606, line 602 is providing an effective shield against the polarity problems and their associated visual effects as noted above. Additional shielding could be provided by having the data on line 602 as the inverse of the data provided on line 606. As there may be some impact on aperture ratio due to the extra column line, it may be desired to compensate for this impact. It is appreciated that this techniques can be applied in combination with other techniques described herein and that all of the techniques herein may be applied in combination with other techniques in the related and co-pending cases noted above.

As it is known upon manufacture of the panel itself, it is possible to compensate for any undesirable visual effect using different techniques. As described in copending and commonly assigned U.S. Patent Publication No. 2004/0246278 ("the '278 application), entitled "SYSTEM AND METHOD FOR COMPENSATING FOR VISUAL EFFECTS UPON PANELS HAVING FIXED PATTERN NOISE WITH REDUCED QUANTIZATION ERROR" and incorporated herein by reference, there are techniques that may be employed to reduce or possibly eliminate for these visual effects. For example, a noise pattern may be introduced to the potential effected columns such that known or estimated darkness or brightness produce by such columns are adjusted. For example, if the column in question is slightly darker than those surrounding columns than the darker column may be adjusted to be slightly more ON than its neighbors, slightly more ON than its neighbors.

What is claimed is:

1. A display panel comprising substantially a set of a subpixel repeating group comprising a pattern of six columns and two rows:

| | | | | | |
|---|---|---|---|---|---|
| R | R | G | B | B | G |
| B | B | G | R | R | G |

wherein at least one set of adjacent column subpixels share image data from a single driver upon the display panel.

2. The display panel of claim 1, wherein the single driver connects to two column lines through an interconnect.

3. The display panel of claim 1, wherein the subpixels are sized substantially the same as RGB striped subpixels.

4. The display panel of claim 1, wherein the adjacent columns across the display panel comprise R R and B B subpixels that share image data via an interconnection from a single driver.

5. The display panel of claim 1, wherein the at least one set of adjacent columns comprise R R and B B subpixels that are driven separately by at least two drivers.

6. The display panel of claim 5, wherein subpixel regions to either side of the at least one set of adjacent columns have different polarities for same colored subpixels.

7. A display panel comprising substantially a first set of a first subpixel repeating group comprising at least an even number of subpixels in a first direction wherein said panel further comprises at least one of a second set of a second subpixel repeating group formed on the display panel, said second subpixel repeating group comprising an odd-number of columns of subpixels and further wherein said second subpixel repeating group is adjacent to said first subpixel repeating group;

wherein said first subpixel repeating group comprises the pattern:

| | | | |
|---|---|---|---|
| R | G | B | G |
| B | G | R | G |

formed substantially across the display panel; and wherein said second subpixel repeating group comprises one of a group of patterns, the group comprising:

| | | | | | | | | | |
|---|---|---|---|---|---|---|---|---|---|
| R | G | B | B | G | B | G | R | R | G |
| B | G | R | R | G | R | G | B | B | G |

formed at least once upon said display panel.

8. In a display panel comprising substantially a set of a subpixel repeating group that comprises a pattern of six columns and two rows:

| | | | | | |
|---|---|---|---|---|---|
| R | R | G | B | B | G |
| B | B | G | R | R | G |

a method comprising:

driving at least one set of adjacent column subpixels with image data from a single driver upon the display panel.

9. The method of claim 8, further comprising:

connecting the single driver to two column lines through an interconnect.

10. The method of claim 8, wherein the subpixels are sized substantially the same as RGB striped subpixels.

11. The method of claim 8, further comprising:

driving adjacent columns across the display panel comprising R R and B B subpixels with image data via an interconnection from a single driver.

12. The method of claim 8, further comprising:

driving at least one set of adjacent columns comprising R R and B B subpixels separately by at least two drivers.

13. The method of claim 12, further comprising:

applying different polarities for same colored subpixels in subpixel regions to either side of the at least one set of adjacent columns.

14. A display panel comprising:

at least one driver; and substantially a set of a subpixel repeating group comprising a pattern of six columns and two rows:

| | | | | | |
|---|---|---|---|---|---|
| R | R | G | B | B | G |
| B | B | G | R | R | G |

wherein at least one set of adjacent column subpixels share image data from the at least one driver upon the display panel.

15. The display panel of claim 14, further comprising:

an extra driver assigned to at least one of double red and double blue subpixel columns of the repeating group.

16. The display of claim 15, wherein subpixels on adjacent sides with respect to the extra driver have different polarities.

17. The display of claim 14, wherein one of the red and blue subpixel columns is split into first and second subpixel components.

18. The display of claim 17, further comprising:

an extra driver assigned to the split subpixel columns.

19. The display of claim 14, further comprising:

an extra driver connected to a column line such that the column line acts as a dummy line.

* * * * *